US006039087A

United States Patent [19]

Thompson, III et al.

[11] Patent Number: 6,039,087

[45] Date of Patent: Mar. 21, 2000

[54] REED ASSEMBLY

[75] Inventors: Robert G. Thompson, III, Taylors; William L. Stenhouse, Greenville, both of S.C.

[73] Assignee: Steel Heddle Manufacturing Co., Greenville, S.C.

[21] Appl. No.: 09/163,625

[22] Filed: Sep. 30, 1998

[51] Int. Cl.[7] ..... D03D 49/62

[52] U.S. Cl. ..... 139/192

[58] Field of Search ..... 139/192

[56] References Cited

U.S. PATENT DOCUMENTS

| | | | |
|---|---|---|---|
| 2,914,094 | 11/1959 | Hutchins . | |
| 3,154,110 | 10/1964 | Rockett | 139/192 |
| 4,471,815 | 9/1984 | Wagner . | |
| 4,611,637 | 9/1986 | Huffman | 139/192 |
| 4,760,869 | 8/1988 | Jenkinson | 139/192 |
| 4,771,813 | 9/1988 | Gaisser . | |
| 4,962,794 | 10/1990 | White . | |
| 4,989,646 | 2/1991 | Nitta et al. . | |
| 5,415,205 | 5/1995 | Stenhouse | 139/192 |

*Primary Examiner*—Andy Falik
*Attorney, Agent, or Firm*—Dority & Manning

[57] ABSTRACT

A reed assembly for use in a textile loom includes a plurality of individual dents held in a top channel and a bottom channel. The reed has a length defined by the ends of the top and bottom channels. The bottom channel is rigidly mounted in a slay for reciprocating movement. A brace member is mounted to the top channel. The brace member defines a recess corresponding essentially to the width and depth of the top channel so as to contact and extend along opposite sides and wrap around the end of the top channel. The brace member may include a vertical portion extending to and contacting with the bottom channel.

17 Claims, 2 Drawing Sheets

REED ASSEMBLY

BACKGROUND OF THE INVENTION

The present invention relates in general to a reed assembly for use in textile weaving machines, and more particularly to a reed assembly having a reinforced end structure.

As is commonly known in the art, reeds are typically longer than the actual width of the fabric they are producing in order to provide space to make fabrics of varying width without interchanging machine components. Also, the additional reed width may be necessary to provide a false selvage in the fabric, or to provide space for mounting a filling detector, filling clamp, or other auxiliary equipment. There are a number of reasons for providing the reed assembly with a wider width than the fabric being manufactured.

With modern day high-speed weaving machines and the weaving of tightly woven fabrics, dynamic forces acting on the reed assembly are relatively large due to the reciprocating motion of the reed and the beat-up of each fill thread or yarn in succession into the fell line of the fabric. It has been found that the reeds tend to suffer rather quick metal fatigue failure when the dynamic forces throughout the portion doing the beat-up are different or out of phase with other portions of the reed that are not subjected to the breaking force of the fell line, or that carry additional devices, such as a detector, clamp, or the like. For example, the dynamic forces acting on the section of the reed assembly defined by the width of the fabric are different than the forces acting on the reed assembly extending beyond the fabric width simply because of the absence of a breaking forcing at the fell line. Also, the dynamic forces acting at the top of the reed assembly, particularly at the ends of the top channel, are different than the forces at the bottom channel which is rigidly mounted in the driving slay. In conventional reed assemblies that incorporate a spacer bar at the ends of the reed for mounting detectors or other devices, it has been found that such configuration is susceptible to failure generally at the interface between the top channel and spacer bar member. It is believed that this failure is due to the different dynamic forces acting on the individual components.

The present invention relates to an improved reed that substantially reduces the effects of varying dynamic forces on the reeds and, thus, substantially increases the life of the reeds.

OBJECTS AND SUMMARY OF THE INVENTION

It is thus a principal object of the present invention to provide an improved reed for a loom that significantly counteracts varying dynamic forces on the reed components.

An additional object of the present invention is to provide an improved reed that substantially reduces or minimizes fatigue generally at the end of the top channel.

Additional objects and advantages of the invention will be set forth in part in the following description, or may be obvious from the description, or may be learned through practice of the invention.

In accordance with the objects and purposes of the invention, an improved reed assembly is provided for a textile loom. As is commonly understood in the art, the loom forms a fabric by moving the reeds in a reciprocating slay between a shed formed by warp yarns to beat-up filler yarns inserted through the shed into a fell line of the fabric. The improved reed according to the invention comprises a plurality of individual dents held in a top channel and a bottom channel. The reed has a length defined by the ends of the top and bottom channels. In certain embodiments, a spacer bar may be held in the top and bottom channels generally at the ends of the channels. In other words, it is not necessary in all embodiments that the dents extend all the way to the ends of the channels. The use of spacer bars is at times preferred in order to provide space on the reed to mount auxiliary equipment, such as detectors, electronics, etc.

A brace member is mounted on the top channel. The brace member defines a recess corresponding essentially to the width and depth of the top channel so as to contact and extend along opposite sides and wrap around the end of the top channel. It has been found that the use of such a brace member significantly reduces or minimizes the risk of metal fatigue and failure of the reed at the critical location of the end of the top channel.

In a preferred embodiment of the invention, the brace member is a generally U-shaped member that is slidable onto the ends of the top channel. The U-shaped member fits tightly onto the top channel and is permanently adhered thereto, for example with the use of a strong epoxy or adhesive. The brace member may comprise a top surface that extends over the top of the top channel.

To further minimize the differences in dynamic forces acting on the reed, in a preferred embodiment of the invention, the brace member further comprises a vertical portion that extends generally perpendicular to the top channel and extends downwardly at the ends of the channels towards the bottom channel. This vertical portion is preferably attached to the bottom channel so as to define a solid contact between the top and bottom channels. The bottom channel is rigidly held in a driving slay, as is commonly understood, and the dynamic forces acting on the bottom channel are significantly less than those acting on the top channel. By defining a solid contacting member between the top and bottom channels, the differences in dynamic forces are minimized. The vertical portion may be attached to the bottom channel in any manner. In one embodiment of the invention, the vertical portion includes vertical sides that lie generally in the same plane as the sides of the brace member extending along the top channel, and a vertical end portion that extends between the ends of the top and bottom channel. The vertical end portion may comprise a downwardly extending leg with or without side portions for attachment to the end of the bottom channel. It may be preferred not to include sides for this downwardly extending leg so that the dimensions of the bottom channel remain the same and the reed can be fitted into any conventional slay clamp.

In an alternative embodiment, the brace member includes a bottom brace member extending generally perpendicular to the vertical portion and attached to the lower channel. The bottom brace is essentially a mirror of the top brace member and has sides extending along the sides of the bottom channel. With this embodiment, however, the clamp of the driving slay would need to accommodate the increased thickness due to the additional bottom brace member.

The accompanying drawings, which are incorporated in and constitute a part of this description, illustrate one embodiment of the invention and, together with the description, serve to explain the principals of the invention.

DETAILED DESCRIPTION

Reference will now be made in detail to the presently preferred embodiments of the invention, one or more examples of which are illustrated in the accompanying drawings. Each example is provided by way of explanation of the invention, and not limitation of the invention. In fact, it will be apparent to those skilled in the art that various modifications and variations can be made in the present invention without departing from the scope or spirit of the invention. For example, features illustrated or described as part of one embodiment can be used on another embodiment to yield still a further embodiment. It is intended that the present invention cover such modifications and variations as come within the scope of the appended claims and their equivalents.

Figure 1:
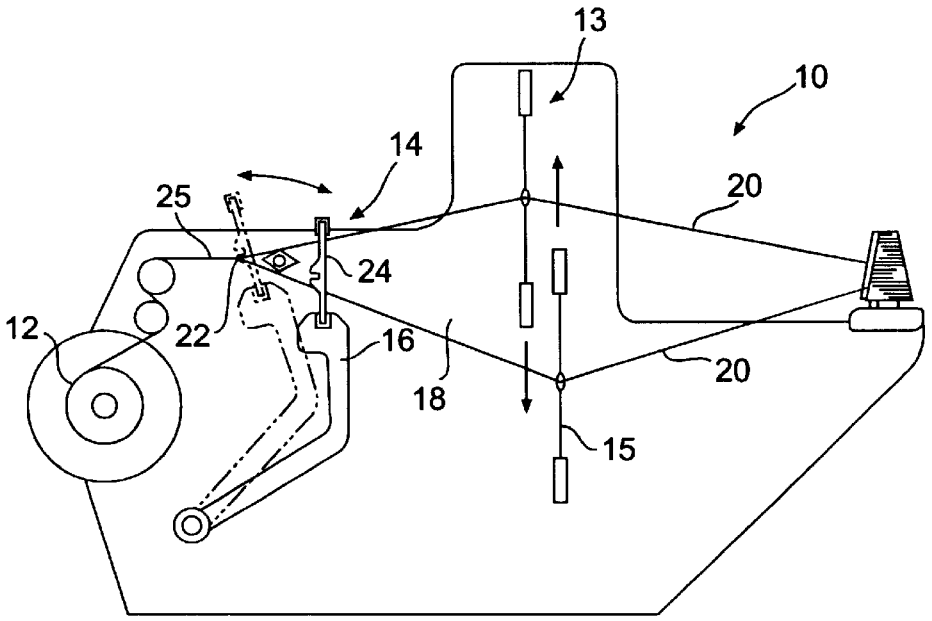
FIG. 1 is a diagrammatic operational view of a conventional loom.

The present invention relates to an improved reed assembly for use in modern high speed weaving looms. FIG. 1 diagrammatically illustrates the basic operational components of a weaving loom and is provided for illustrative purposes. The operation of such looms is well understood by those skilled in the art and a detailed description thereof is not necessary for purposes of explaining the present invention. In general, loom 10 utilizes heddles 15 carried in heddle frames 13 to move warp yarns 20 in a reciprocating up and down motion to define a shed 18. A fill yarn is passed through the shed by components not illustrated. Reed 14 is mounted on a reciprocating slay 16 that drives reed 14 in a back and forth motion as indicated in FIG. 1 for beating-up fill threads 22 against the fell line 25 of fabric 12 being produced. This operation is well understood by those skilled in the art.

Figure 2:
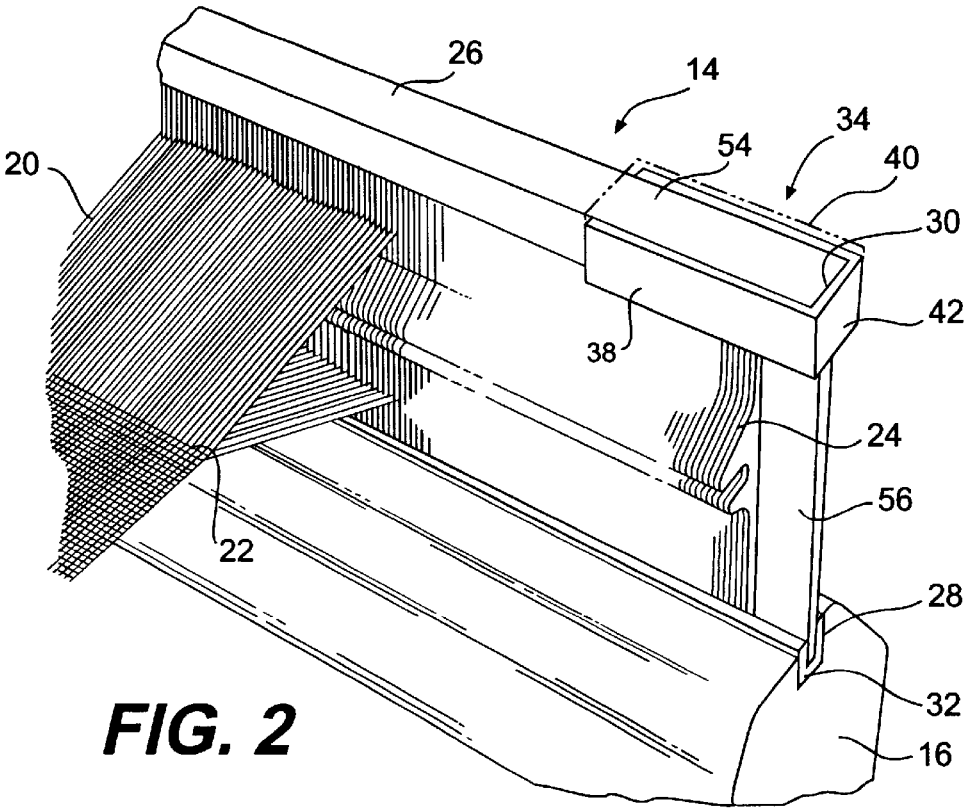
FIG. 2 is an enlarged partial perspective view of a reed assembly incorporating the brace according to the present invention.

With conventional reeds, the dents 24 are adjacently disposed and held in top channel member 26 and bottom channel member 28. The ends of the dents are tightly fitted into recesses in the top and bottom channels and are generally held therein with a strong epoxy. Bottom channel 28 is typically rigidly held in the driving slay 16 for driving reed 14 in the direction indicated by the arrow in FIG. 1. When the reeds 14 are driven to the left to beat up fill yarns against the fell line, a breaking force is imparted to reeds 14 generally at fell line 25. However, the top half of dents 24, and thus reed 14, and the end portions of reed 14 that are not producing fabric, as generally illustrated in FIG. 2, are not subjected to the same instantaneous breaking force and thus top channel member 26 has a tendency under its own momentum to continue its motion to the left. This tendency is greatly exaggerated at the ends of reeds 14 wherein the fabric is not being produced and the dents 24 are not subjected to the breaking force of the fell line. This situation is exaggerated by the fact that top channel member 26 is generally not rigidly connected to bottom channel member 28 or slay 16. When reed 14 is driven back to the right by slay 16, top channel 26, particularly at the end portions thereof, is again subjected to different dynamic forces since the moment arm of slay 16 is different from top channel 26 to bottom channel 28. Thus, it should be appreciated that reed 14 is subjected to varying dynamic forces along its vertical and horizontal aspects.

FIG. 2 illustrates a reed 14 utilizing a spacer bar 56 at the ends 30, 32 of top and bottom channel members 26, 28. Spacer bar 56 is generally held in the channels similar to dents 24 and provides a longitudinal extension to reed 14 in order to mount detectors, or other devices. The additional weight of such devices also adds to the varying dynamic forces on reed 14. Reeds incorporating spacer bar 56 are particularly prone to failure generally at the location of the top channel member 26 and spacer bar 56. Even though spacer bars 56 are typically made of metal, the bars still prematurely fail which requires replacement of the entire reed 14.

In order to support reeds 14 at the more critical location at the ends of top channels 26, a brace member 34 is incorporated into reed 14.

One preferred embodiment of brace member 34 is illustrated in FIG. 2. In this embodiment, brace member 34 comprises a generally U-shaped member having sides 38, 40 and an end 42. The sides and end define a recess 36 corresponding essentially to the width and depth of top channel 26 so that brace member 34 slides tightly onto top channel member 26. Brace 34 may include a top surface 54 as indicated in dashed lines in FIG. 2. Brace 34 is slid onto top channel member 26 and permanently adhered thereto by use of an epoxy or any other conventional adhering or attaching means.

Sides 38, 40 of brace member 34 have a longitudinal length so as to extend longitudinally beyond spacer bar 56 into the area of dents 24. End 42 is also adhered directly against end 30 of top channel member 26 and the side edge of spacer bar 56. Applicant has found that the use of this relatively simple corner brace or cap 34 reduces fatigue and breakage of reeds 14 generally at the location of the top end of channel member 26. It is believed that brace member 34 distributes the dynamic forces longitudinally along the length of sides 38, 40 so that the forces are not concentrated at the end of top channel member 26. In this regard, it may be preferred to extend sides 38 and 40 with consideration being given to the additional weight being added to top channel member 26. Sides 38 may have a longitudinal length so as to extend generally to the area of reed 14 producing fabric, although not illustrated in the figures. At some point, the weight of brace member 34 would detract from the benefits thereof.

Figure 3:
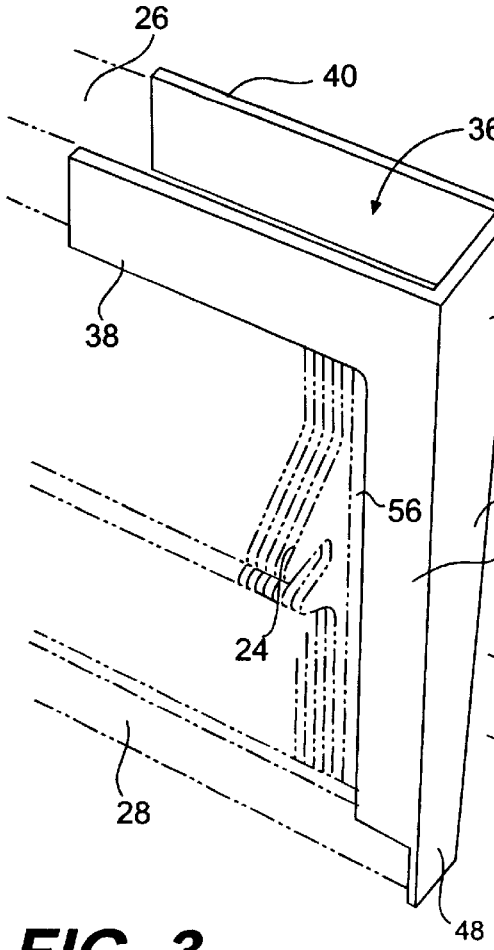
FIG. 3 is an additional perspective view of an alternative brace according to the invention.

An alternative preferred embodiment of brace member 34 is illustrated in FIG. 3. In this embodiment, brace member 34 includes a vertically extending portion 42. Portion 42 extends vertically from end 30 of upper channel member 26 to end 28 of lower channel member 32. Thus, vertical portion 44 ends in a plane generally perpendicular to top channel member 26. The inside surface of vertical portion 44 would lie directly against the end of spacer bar 56 in the embodiment wherein a spacer bar is utilized.

As illustrated in FIG. 3, vertically extending portion 44 is preferably directly contacting bottom channel member 28. In the embodiment illustrated, a vertically extending leg 48 extends against end 28 of lower channel member 32 and is adhered or attached thereto. In this manner, a direct solid contact is made between upper channel member 26 and lower channel member 28 through the use of brace member 34. Vertically extending portion 44 may also include sides 46 that extend generally to the top of lower channel member 28. It may be preferred not to extend sides 46 as far as vertical leg 48 so that the width or thickness of lower channel member 28 is not changed and reed 14 can be held in the same clamp of a conventional slay.

The embodiment of FIG. 3 is particularly useful in that brace member 34 further dampens and minimizes dynamic forces between upper channel member 26 and lower channel member 28 by making direct contact between the two channel members.

Figure 4:
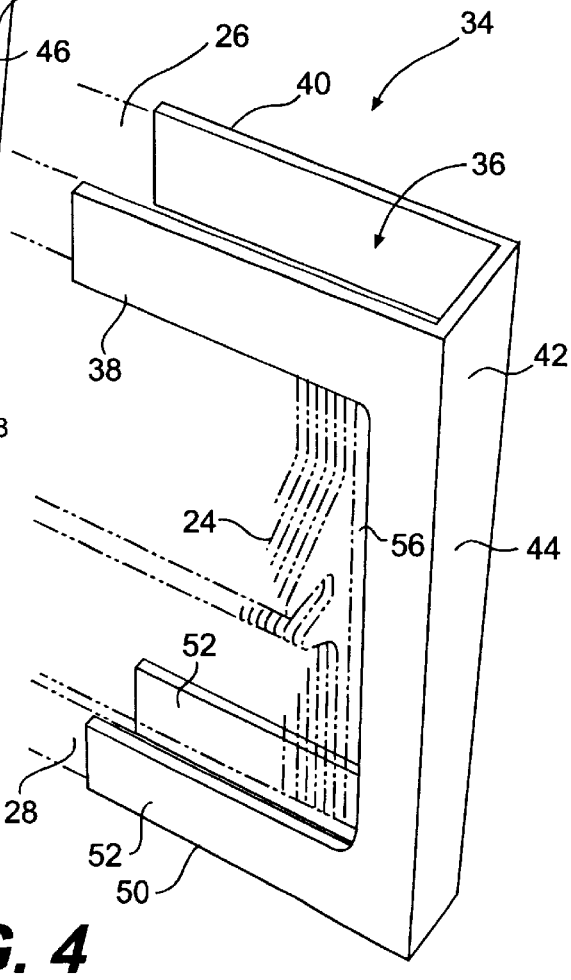
FIG. 4 is a partial perspective view of yet an alternative embodiment of the brace according to the invention.

An alternative embodiment similar to that of FIG. 3 is illustrated in FIG. 4. In this embodiment, brace member 34 includes a bottom brace member 50 extending generally perpendicular to vertical portion 44 and having sides 52 attached to the sides of lower channel member 28. This embodiment further structurally supports the end of reed 14 but would require that the slay clamp accommodate the increased thickness along bottom channel member 28.

It should appreciated by those skilled in the art that various modifications and variations can be made in the present invention without departing from the scope or spirit of the invention. It is intended that the present invention include such modifications and variations as come within the scope of the appended claims and their equivalents.

What is claimed is:

1. A reed assembly for a textile loom wherein the loom forms a fabric by moving reeds in a slay between a shed formed by warp yarns to beat up filler yarns inserted through the shed into a fell line of the fabric, said reed assembly comprising:

a reed comprising a plurality of individual dents held in a top channel and a bottom channel, said reed having a length defined by ends of said top and bottom channels, said bottom channel rigidly mounted in a slay for reciprocating movement therewith; and a brace member mounted to said top channel, said brace member defining a recess corresponding essentially to the width and depth of said top channel and extending longitudinally along opposite sides and wrapping around said end of said top channel.

2. The reed assembly as in claim 1, wherein said brace member is a generally U-shaped member slidable onto said top channel.

3. The reed assembly as in claim 1, wherein said brace member comprises a top surface so as to extend over a top of said top channel.

4. The reed assembly as in claim 1, wherein said brace member is non-adjustably secured to said top channel.

5. The reed assembly as in claim 1, wherein said brace member further comprises a vertical portion extending generally perpendicular to said top channel alongside said dents.

6. The reed assembly as in claim 5, wherein said vertical portion is attached to said lower channel.

7. The reed assembly as in claim 6, wherein said vertical portion includes side members and a downwardly projecting leg attached to said end of said lower channel.

8. The reed assembly as in claim 1, further comprising a spacer bar with ends thereof disposed in said upper and lower channels, said spacer bar disposed adjacent said dents and extending generally to said ends of said upper and lower channels.

9. The reed assembly as in claim 1, wherein said brace member has a longitudinal length so as to extend at least to a portion of said reed defining a width of the fabric being made.

10. A reed assembly for a textile loom wherein the loom forms a fabric by moving reeds in a slay between a shed formed by warp yarns to beat up filler yarns inserted through the shed into a fell line of the fabric, said reed assembly comprising:

a reed comprising a plurality of individual dents held in a top channel and a bottom channel, said reed having a length defined by ends of said top and bottom channels, said bottom channel rigidly mounted in a slay for reciprocating movement therewith;

a spacer bar having ends disposed in said top and bottom channels with one side thereof adjacent said dents and an opposite side thereof generally flush with said ends of said top and bottom channels; and a brace member mounted to said top channel, said brace member defining a recess corresponding essentially to the width and depth of said top channel and extending longitudinally along opposite sides and wrapping around said end of said top channel, said brace member extending along said top channel at least past said spacer bar.

11. The reed assembly as in claim 10, wherein said brace member is a generally U-shaped member slidable onto said top channel.

12. The reed assembly as in claim 10, wherein said brace member comprises a top surface so to extend over a top of said top channel.

13. The reed assembly as in claim 10, wherein said brace member is non-adjustably secured to said top channel.

14. The reed assembly as in claim 10, wherein said brace member further comprises a vertical portion extending generally perpendicular to said top channel alongside said dents and attached to said lower channel.

15. The reed assembly as in claim 14, wherein said vertical portion includes side members and a downwardly projecting leg attached to said end of said lower channel.

16. A reed assembly for a textile loom wherein the loom forms a fabric by moving reeds in a slay between a shed formed by warp yarns to beat up filler yarns inserted through the shed into a fell line of the fabric, said reed assembly comprising:

a reed comprising a plurality of individual dents held in a top channel and a bottom channel, said reed having a length defined by ends of said top and bottom channels, said bottom channel rigidly mounted in a slay for reciprocating movement therewith;

a brace member mounted to said top channel, said brace member defining a recess corresponding essentially to the width and depth of said top channel so as to contact and extend along opposite sides and wrap around said end of said top channel; and wherein said brace member further comprises a vertical portion extending generally perpendicular to said top channel alongside said dents and attached to said lower channel; and further comprising a bottom brace member extending generally perpendicular to said vertical portion and attached to said lower channel, said bottom brace member extending along and attached to opposite sides of said lower channel and wrapping around said end of said lower channel.

17. A reed assembly for a textile loom wherein the loom forms a fabric by moving reeds in a slay between a shed formed by warp yarns to beat up filler yarns inserted through the shed into a fell line of the fabric, said reed assembly comprising:

a reed comprising a plurality of individual dents held in a top channel and a bottom channel, said reed having a length defined by ends of said top and bottom channels, said bottom channel rigidly mounted in a slay for reciprocating movement therewith;

a spacer bar having ends disposed in said top and bottom channels with one side thereof adjacent said dents and an opposite side thereof generally flush with said ends of said top and bottom channels;

a brace member mounted to said top channel, said brace member defining a recess corresponding essentially to the width and depth of said top channel so as to contact and extend along opposite sides and wrap around said end of said top channel, said brace member extending along said top channel at least past said spacer bar, said brace member further comprising a vertical portion extending generally perpendicular to said top channel alongside said dents and attached to said lower channel; and further comprising a bottom brace member extending generally perpendicular to said vertical portion and attached to said lower channel, said bottom brace member extending along and attached to opposite sides of said lower channel and wrapping around said end of said lower channel.

* * * * *